US007234980B2

(12) United States Patent
Jazowski et al.

(10) Patent No.: US 7,234,980 B2
(45) Date of Patent: Jun. 26, 2007

(54) LOADBREAKING ELECTRICAL CONNECTOR PROBE WITH ENHANCED THREADING AND RELATED METHODS

(75) Inventors: Roy E. Jazowski, Ormond Beach, FL (US); Paul W. Lubinsky, Palm Coast, FL (US)

(73) Assignee: Homac Mfg. Company, Ormond Beach, FL (US)

( * ) Notice: Subject to any disclaimer, the term of this patent is extended or adjusted under 35 U.S.C. 154(b) by 0 days.

(21) Appl. No.: 11/380,534

(22) Filed: Apr. 27, 2006

(65) Prior Publication Data

US 2006/0189221 A1 Aug. 24, 2006

Related U.S. Application Data

(62) Division of application No. 10/916,012, filed on Aug. 11, 2004, now Pat. No. 7,108,568.

(51) Int. Cl.
*H01R 4/38* (2006.01)

(52) U.S. Cl. ..... 439/801; 439/921

(58) Field of Classification Search ..... 439/181–187, 439/801, 921

See application file for complete search history.

(56) References Cited

U.S. PATENT DOCUMENTS

| | | | | |
|---|---|---|---|---|
| 3,390,331 | A | 6/1968 | Brown et al. | 324/122 |
| 3,736,505 | A | 5/1973 | Sankey | 324/133 |
| 4,222,625 | A | 9/1980 | Reed | 339/143 |
| 4,722,694 | A | 2/1988 | Makal et al. | 439/181 |
| 5,421,750 | A | 6/1995 | Crotty | 439/801 |
| 5,573,410 | A | 11/1996 | Stepniak | 439/88 |
| 5,795,180 | A | 8/1998 | Siebens | 439/489 |
| 5,836,731 | A | 11/1998 | Goodwin et al. | 411/386 |
| 6,162,001 | A | 12/2000 | Goodwin et al. | 411/386 |
| 6,328,515 | B1 | 12/2001 | Donovan | 411/386 |
| 6,561,741 | B2 | 5/2003 | Garver | 411/386 |
| 2004/0102091 | A1 | 5/2004 | Jazowski et al. | 439/606 |

OTHER PUBLICATIONS

Loadbreak apparatus Connectors, pp. 1-4, Jan. 1998, Cooper Power Systems, Inc. available at www.cooperpower.com/Library/pdf/50024.pdf.

Technical Information MATpoint (M point), available at www.mathread.com/technical.php, 2001 MATread Inc.

*Primary Examiner*—Khiem Nguyen
(74) *Attorney, Agent, or Firm*—Allen, Dyer, Doppelt, Milbrath & Gilchrist, P.A.

(57) ABSTRACT

A loadbreak electrical connector may include a housing having first and second intersecting passageways therein, and a conductive member to be received in the first passageway. The conductive member may have a first end to receive a cable end, and have a transverse internally threaded opening adjacent a second end thereof accessible via the second passageway. A loadbreak probe may be received in the second passageway and have an externally threaded end for threading into the threaded opening. The threaded end of the loadbreak probe may include a proximal portion and a bullnose tip connected thereto, or a self-aligning anti cross-threading tip.

18 Claims, 3 Drawing Sheets

LOADBREAKING ELECTRICAL CONNECTOR PROBE WITH ENHANCED THREADING AND RELATED METHODS

CROSS-REFERENCE TO RELATED APPLICATION

This is a divisional patent application of U.S. patent application Ser. No. 10/916,012 filed Aug. 11, 2004 now U.S. Pat. No. 7,108,568, the entire disclosure of which is hereby incorporated in its entirety.

FIELD OF THE INVENTION

The present invention relates to the field of electrical products, and, more particularly, to electrical connectors for electrical systems and associated methods.

BACKGROUND OF THE INVENTION

An electrical distribution system typically includes distribution lines or feeders that extend out from a substation transformer. The substation transformer is typically connected to a generator via electrical transmission lines.

Along the path of a feeder, one or more distribution transformers may be provided to further step down the distribution voltage for a commercial or residential customer. The distribution voltage range may be from 5 through 46 kV, for example. Various connectors are used throughout the distribution system. In particular, the primary side of a distribution transformer typically includes a transformer bushing to which a bushing insert is connected. In turn, an elbow connector, for example, may be removably coupled to the bushing insert. The distribution feeder is also fixed to the other end of the elbow connector. Of course, other types of connectors are also used in a typical electrical power distribution system. For example, the connectors may be considered as including other types of removable connectors, as well as fixed splices and terminations. Large commercial users may also have a need for such high voltage connectors.

One particular difficulty with conventional elbow connectors is that they use curable materials. For example, such a connector may typically be manufactured by molding the inner semiconductive layer first, then the outer semiconductive jacket (or vise-versa). These two components are placed in a final insulation press and then insulation layer is injected between these two semiconductive layers. Accordingly, the manufacturing time is relatively long, as the materials need to be allowed to cure during manufacturing. In addition, the conventional EPDM materials used for such elbow connectors and their associated bushing inserts may have other shortcomings as well.

One particularly advantageous elbow connector configuration which addresses many of these shortcomings is disclosed in U.S. Pat. Pub. No. 2004/0102091 to Jazowski et al., which is assigned to the present Assignee. This application discloses an elbow connector including a connector body having a passageway therethrough. The connector body includes a first thermoplastic elastomer (TPE) layer adjacent the passageway, a second TPE layer surrounding the first layer and comprising an insulative material, and a third TPE layer surrounding the second layer. The TPE material layers may be overmolded to thereby increase production speed and efficiency and lower production costs. The TPE material may also provide excellent electrical performance and other advantages as well.

Despite such advancements in fabrication, typical elbow connectors may experience other shortcomings with respect to installation. More particularly, an elbow connector includes first and second interconnecting passageways. A conductive member having a threaded opening is positioned in the first passageway so that the threaded opening is accessible via the second passageway. A loadbreak probe is inserted into the second passageway and has a threaded end to be threaded into the opening of the conductive member to provide an electrical (as well as mechanical) connection therewith.

The threaded end portion of an exemplary prior art loadbreak probe 100 is illustrated in FIG. 6. The probe 100 illustratively includes a cylindrical body 101 and a threaded end including a shaft 102 extending from the body. The shaft 102 has a constant diameter d along an entire length l thereof, and threads 103 extend along the shaft from the body 101 to about three-quarters of the length up the shaft, leaving an unthreaded tip 104. One drawback of this arrangement is that when installers insert the probe 100 into the second passageway of the elbow connector, they may have difficulty seeing the internally threaded opening of the conductive member and the threaded end of the probe. Further, the conductive member can get turned within the first passageway so that the threaded opening is not properly aligned with the second passageway. Thus, it is quite possible for an installer to have difficulty aligning the probe with the threaded opening of the electrode. As a result, cross-threading may occur, and thus upon tightening the probe with a probe tightening tool the threads of the opening and/or the probe may be damaged. If detected, this requires replacement, and, if undetected, may result in premature failure.

SUMMARY OF THE INVENTION

In view of the foregoing background, it is therefore an object of the present invention to provide a loadbreak electrical connector that provides for more ready and reliable interconnection and related methods.

This and other objects, features, and advantages in accordance with the present invention are provided by a loadbreak electrical connector that may include a loadbreak probe having an enhanced threaded end configuration. The connector may include a housing having first and second intersecting passageways therein, and a conductive member to be received in the first passageway. The conductive member may have a first end to receive a cable end, and a transverse internally threaded opening adjacent a second end thereof being accessible via the second passageway. The loadbreak probe may have an externally threaded end to be threaded into the transverse internally threaded opening of the conductive member.

More particularly, the externally threaded end of the loadbreak probe may include a proximal portion and a bullnose tip connected thereto. The proximal portion may include a proximal shaft having a constant predetermined diameter, and a proximal helical rib extending radially outwardly from the proximal shaft. Furthermore, the bullnose tip may include a distal shaft connected to the proximal shaft and a distal helical rib connected to the proximal helical rib. The distal shaft may have a tapered diameter. Accordingly, the bullnose tip advantageously provides a self-aligning arrangement.

The proximal portion of the externally threaded end may have a length matching a depth of the transverse internally threaded opening of the conductive member. In addition, the proximal helical rib may extend radially outwardly a constant predetermined distance from the proximal shaft, and the distal helical rib may also extend radially outwardly the constant predetermined distance from at least portions of the distal shaft.

Further, the tapered diameter of the distal shaft may end at a point defining a pointed bullnose tip. Alternately, the tapered diameter of the distal shaft may end at a predetermined diameter defining a blunt bullnose tip.

The conductive member may include a compressible tubular body and a conductive tab connected thereto. Also, the housing may have an elbow shape in some embodiments. The housing may include an innermost semiconductive layer, an intermediate insulation layer, and an outermost semiconductive layer.

In other embodiments, the externally threaded end may include a proximal portion and a self-aligning, anti-cross threading tip connected thereto. The proximal portion may include a proximal shaft having a constant predetermined diameter and a proximal helical rib extending radially outwardly a first distance from the proximal shaft. The self-aligning, anti-cross threading tip may include a distal shaft connected to the proximal shaft, and a distal helical rib connected to the proximal helical rib and extending radially outwardly from the distal shaft a second distance less than the first distance. The distal helical rib may also terminate prior to an end of the distal shaft to define an unthreaded lead-in.

The proximal portion of the externally threaded end may have a length matching a depth of the transverse internally threaded opening of the conductive member. Further, the distal helical rib may have a rounded over outer shape. The distal helical rib may alternatively have a flat outer shape, and the distal shaft may have an enlarged diameter along the unthreaded lead-in.

Other advantageous aspects of the invention relate to loadbreak probes and methods for making electrical connectors, such as those briefly described above.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
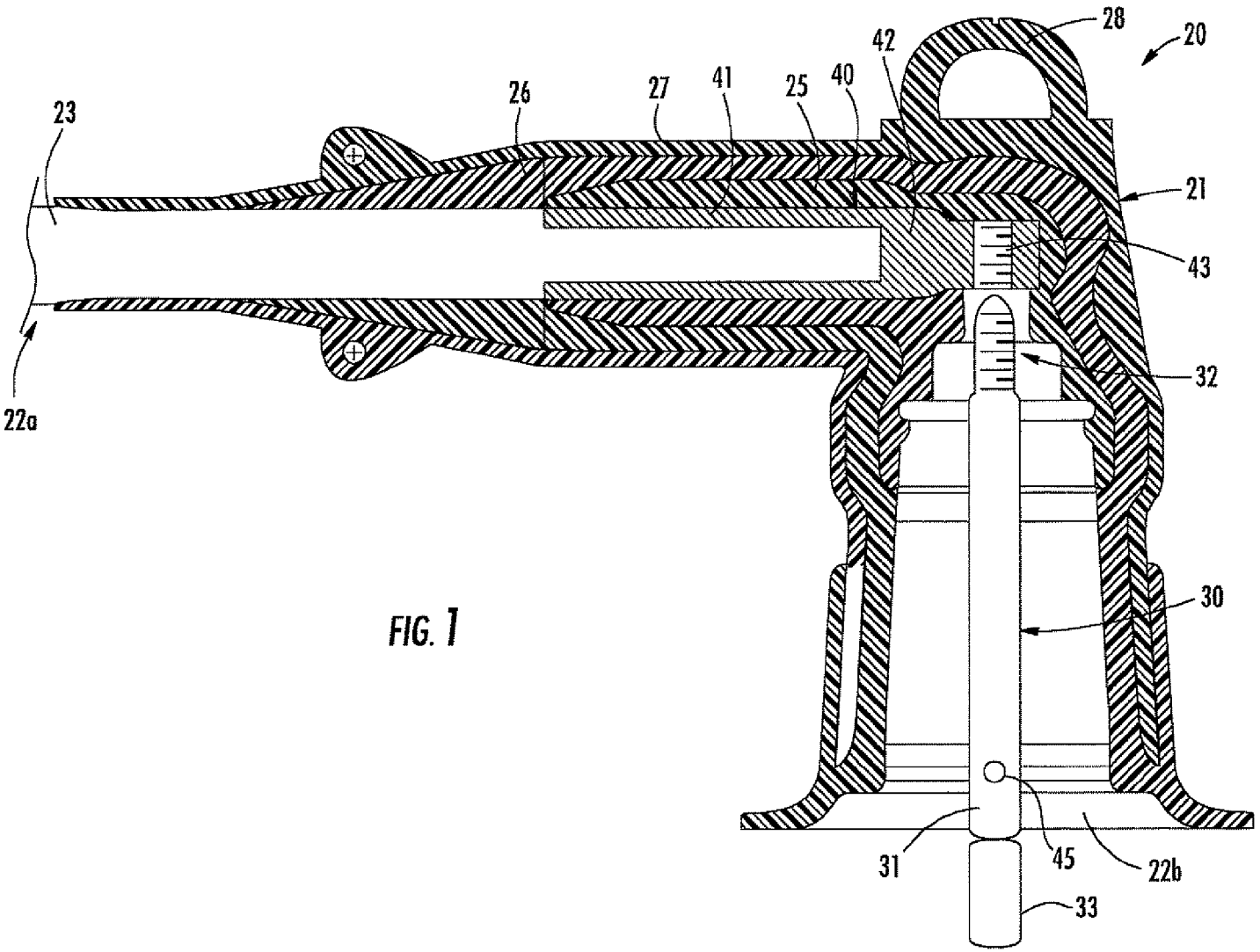
FIG. 1 is a longitudinal partial cross-sectional view of an elbow connector in accordance with the present invention illustrating advancement of the loadbreak probe toward the conductive member.
Figure 2:
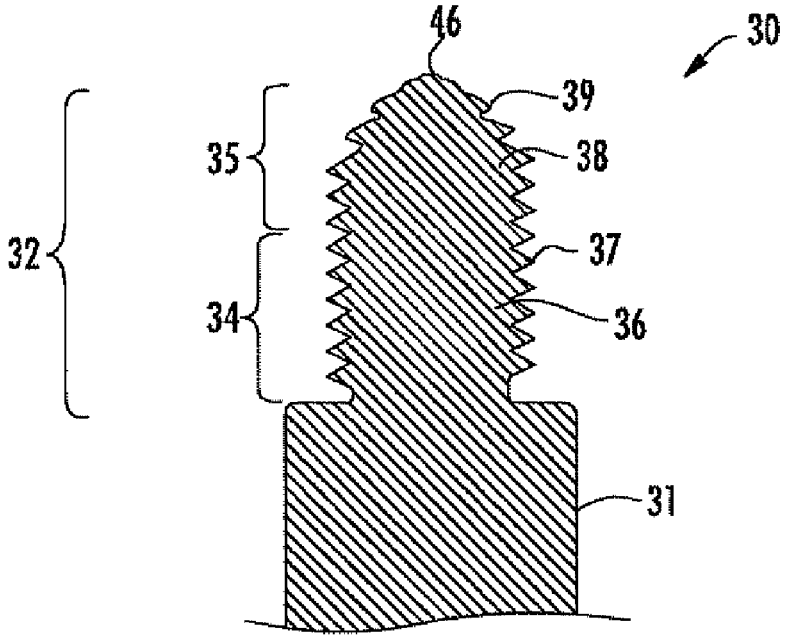
FIG. 2 is a cross-sectional view of the threaded end of a loadbreak probe of the elbow connector as shown in FIG. 1.

Referring initially to FIGS. 1 and 2, an electrical elbow connector 20 in accordance with the present invention is initially described. As will be appreciated by those skilled in the art, the elbow connector 20 is but one example of an electrical connector, such as for high voltage power distribution applications, comprising a connector body 21 having first and second intersecting passageways 22*a*, 22*b* therethrough. That is, the present invention may advantageously be applicable to other connector types (T-shaped, etc.), as well.

The connector body 21 defines an elbow and includes a first layer 25 adjacent the passageways 22*a*, 22*b*, a second layer 26 surrounding the first layer, and a third layer 27 surrounding the second layer. As illustrated, the first layer 25 defines an innermost layer, and the third layer 27 defines the outermost layer. The connector 20 also illustratively includes a pulling eye 28 carried by the connector body 21. The pulling eye 28 may have a conventional construction and needs no further discussion herein.

At least the second layer 26 may comprise an insulative thermoplastic elastomer (TPE) material. The first and third layers 25, 27 also preferably have a relatively low resistivity. The first and third layers 26,27 may comprise a semiconductive TPE material. In other embodiments, the layers may comprise another material, such as a conventional EPDM, as will be appreciated by those skilled in the art. Further details regarding the connector housing 21 may be found in the above-noted U.S. Pat. Pub. No. 2004/0102901, which is hereby incorporated herein in its entirety by reference.

A conductive member 40 is inserted into and thereby received in the first passageway 22*a*. The conductive member 40 illustratively includes a compressible tubular body 41 for receiving an end of an electrical cable 23 and a conductive tab 42 connected thereto. The conductive tab 42 has a transverse internally threaded opening 43 which is accessible via the second passageway 22*b*, as seen in FIG. 1.

A loadbreak probe 30 is received in the second passageway 22*b*. The loadbreak probe 30 illustratively includes a cylindrical loadbreak probe body 31 with an externally threaded end 32 to be threaded into the transverse internally threaded opening 43 of the conductive member 40. Of course, it will be appreciated that the body 31 may have other shapes in alternate embodiments. An insulated portion 33 may optionally be connected to the other end of the body 31 opposite the externally threaded end 32 to provide arc quenching properties as will be appreciated by those skilled in the art.

More particularly, the externally threaded end 32 of the loadbreak probe 30 illustratively includes a proximal portion 34 and a bullnose tip 35 connected thereto. The proximal portion 34 illustratively includes a proximal shaft 36 having a constant predetermined diameter, and a proximal helical rib 37 extending radially outwardly from the proximal shaft to define threads. The bullnose tip 35 illustratively includes a distal shaft 38 connected to the proximal shaft 36, and a distal helical rib 39 (i.e., threads) connected to the proximal helical rib 37.

The distal shaft 38 advantageously has a tapered diameter as shown, which causes the loadbreak probe 30 to be "self-aligning." That is, because the distal shaft 38 tapers, even when it is inserted in the opening 43 at an angle not orthogonal therewith, the taper will cause the loadbreak probe 30 and the opening 43 to come into an orthogonal alignment as the probe is screwed into the opening, as will be appreciated by those skilled in the art. A tool hole 45 in the base 31 of the loadbreak probe 30 may be used for screwing the probe into the opening 43, as will also be appreciated by those skilled in the art.

The proximal portion 34 of the externally threaded end 32 may have a length matching a depth of the transverse internally threaded opening 43 of the conductive member 40, although this need not be the case in all embodiments. By way of example, the proximal portion 34 may be in a range of about 9 to 11 mm in length (and, more preferably about 10 mm), while the bullnose tip may be in a range of about 4 to 6 mm in length (and, more preferably about 5 mm), although other dimensions may also be used. The proximal helical rib 37 preferably extends radially outwardly a constant predetermined distance (e.g., about 1 mm) from the proximal shaft 36, and the distal helical rib 39 preferably extends radially outwardly the constant predetermined distance from at least portions of the distal shaft 38. That is, the rib 39 height may be shortened where the tapered diameter of the distal shaft 38 ends at a point 46 defining a pointed bullnose tip in the illustrated embodiment.

Figure 3:
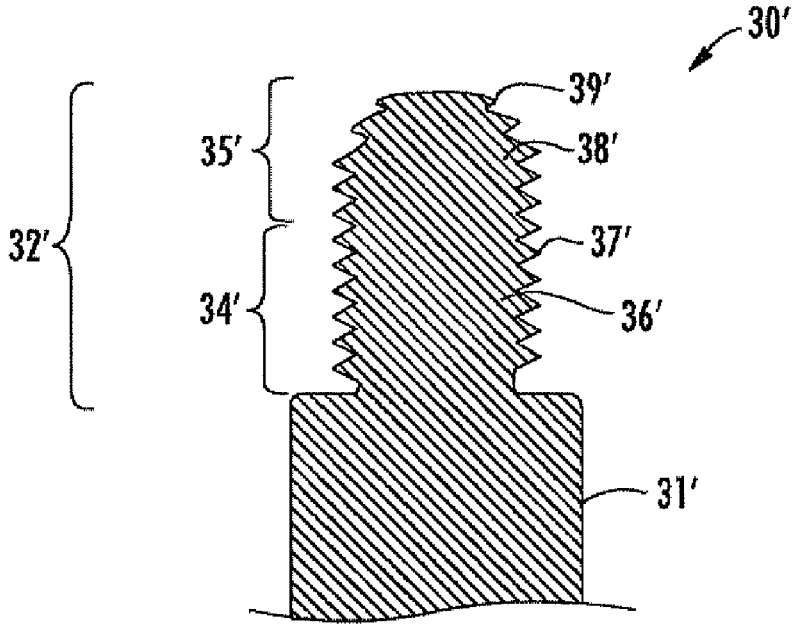
FIG. 3 is a cross-sectional view of a variation of the threaded end of the loadbreak probe as shown in FIG. 2.

In accordance with a variation of the loadbreak probe 30' shown in FIG. 3, the various portions of the probe are similar to those described above except that the tapered diameter of the distal shaft 38' ends at a predetermined diameter defining a blunt bullnose tip. Here again, the blunt bullnose tip configuration provides similar self-aligning insertion to that of the pointed bullnose tip described above to thereby reduce cross-threading. By way of example, the length of the blunt bullnose tip may be in a range of about 2 to 4 mm, and, more preferable, about 3 mm, although other dimensions may be used as well.

Figure 4:
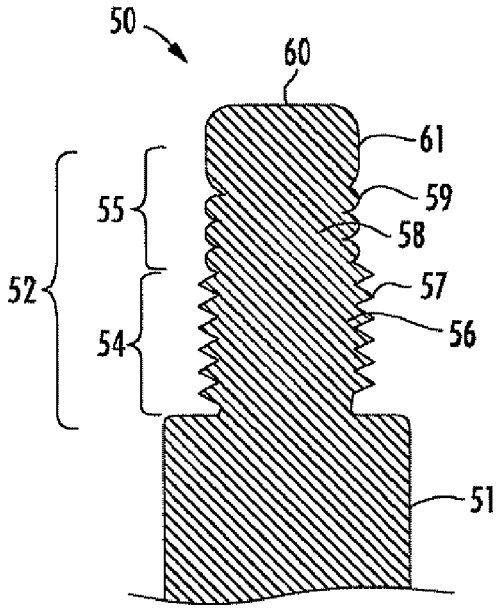
FIG. 4 is a cross-sectional view of another embodiment of the threaded end of the loadbreak probe as shown in FIG. 1.
Figure 5:
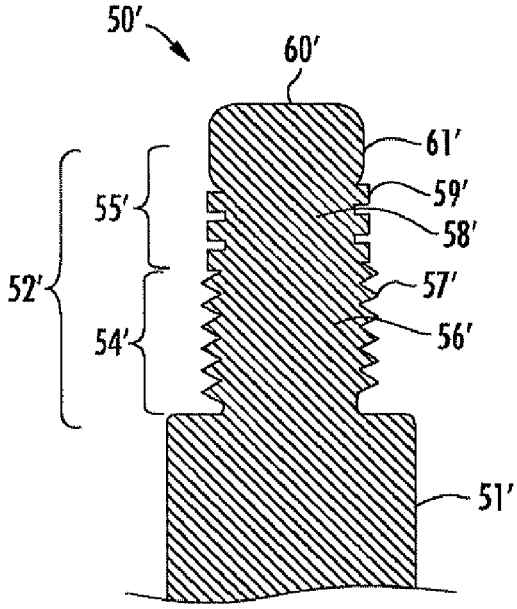
FIG. 5 is a cross-sectional view of a variation of the threaded end of the loadbreak probe as shown in FIG. 4.
Figure 6:
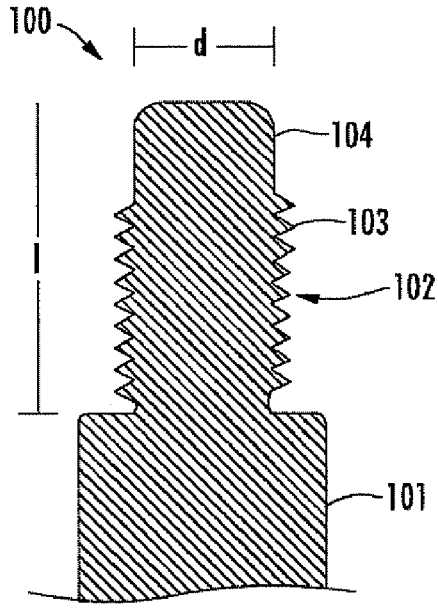
FIG. 6 PRIOR ART
FIG. 6 is a side view of a prior art loadbreak probe.

In another class of embodiments of the loadbreak probe 50 shown in FIGS. 4 and 5, an externally threaded end 52 is connected to a body 51. The externally threaded end 52 illustratively includes a proximal portion 54 and a self-aligning, anti-cross threading tip 55 connected thereto. The proximal portion 54 illustratively includes a proximal shaft 56 having a constant predetermined diameter and a proximal helical rib 57 extending radially outwardly a first distance (e.g., about 1 mm) from the proximal shaft to define threads.

Furthermore, the self-aligning, anti-cross threading tip 55 illustratively includes a distal shaft 58 connected to the proximal shaft 56, and a distal helical rib 59 connected to the proximal helical rib 57 also defining threads which extend radially outwardly from the distal shaft a second distance less than the first distance (e.g., less than 1 mm), as shown. The distal helical rib 59 preferably terminates prior to an end 60 of the distal shaft 59 to define an unthreaded lead-in 61. Further, the distal helical rib 59 may have a rounded over outer shape, as shown in FIG. 4, or, alternately, a flat outer shape, as shown in FIG. 5. The distal shaft 58 may also have an enlarged diameter along the unthreaded lead-in. By way of example, both the proximal portion 54 and the anti-cross threading tip 55 may each have a respective length in a range of about 8 to 10 mm, and, more preferably, about 9 mm. The unthreaded portion 61 may have a length in a range of about 3 to 5 mm, and more particularly, about 4 mm. Here again, other dimensions may also be used, By way of example, the externally threaded end 52 may be produced using a die from MAThread Inc., as described further in U.S. Pat. Nos. 5,836,731, 6,162,001, and 6,561,741, which are hereby incorporated herein in their entireties by reference. Of course, other suitable dies or manufacturing methods may also be used.

A method aspect of the invention for making a loadbreak electrical connector may include forming a housing 21 having first and second intersecting passageways 22*a*, 22*b* therein, and forming a conductive member 40 to be received in the first passageway 22*a*. The conductive member 40 may have a first end to receive an end of a cable 23, and a transverse internally threaded opening 43 adjacent a second end thereof being accessible via the second passageway 22*b*. The method may also include forming a loadbreak probe 30 to be received in the second passageway 22*b*, the loadbreak probe 30 having an externally threaded end 32 to be threaded into the transverse internally threaded opening 43 of the conductive member 40, as described further above. In accordance with an alternate method aspect of the invention, a loadbreak probe 50 may be formed, as described above, to be received in the second passageway 22*b*.

It should be noted that the various embodiments of the self-aligning, anti-cross threading loadbreak probes described herein may advantageously be used with other types of loadbreak electrical connectors. This may include different types of elbow connectors, as well as T-shaped connectors, etc.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A loadbreak electrical connector comprising:

a housing having first and second intersecting passageways therein;

a conductive member to be received in the first passageway, said conductive member having a first end to receive a cable end and having a transverse internally threaded opening adjacent a second end thereof being accessible via the second passageway; and a loadbreak probe to be received in the second passageway, said loadbreak probe having an externally threaded end to be threaded into the transverse internally threaded opening of said conductive member;

said externally threaded end comprising a proximal portion and a self-aligning, anti-cross threading tip connected thereto;

said proximal portion comprising a proximal shaft having a constant predetermined diameter and a proximal helical rib extending radially outwardly a first distance from said proximal shaft;

said self-aligning, anti-cross threading tip comprising a distal shaft connected to said proximal shaft and a distal helical rib connected to said proximal helical rib and extending radially outwardly from said distal shaft a second distance less than the first distance, said distal helical rib also terminating prior to an end of said distal shaft to define an unthreaded lead-in.

2. The loadbreak electrical connector of claim 1 wherein said proximal portion of said externally threaded end has a length matching a depth of the transverse internally threaded opening of the conductive member.

3. The loadbreak electrical connector of claim 1 wherein said distal helical rib has a rounded over outer shape.

4. The loadbreak electrical connector of claim 1 wherein said distal helical rib has a flat outer shape.

5. The loadbreak electrical connector of claim 1 wherein said distal shaft has an enlarged diameter along the unthreaded lead-in.

6. The loadbreak electrical connector of claim 1 wherein said conductive member comprises a compressible tubular body and a conductive tab connected thereto.

7. The loadbreak electrical connector of claim 1 wherein said housing has an elbow shape.

8. The loadbreak electrical connector of claim 1 wherein said housing comprises an innermost semiconductive layer, an intermediate insulation layer, and an outermost semiconductive layer.

9. A loadbreak probe for a loadbreak electrical connector comprising a housing having first and second intersecting passageways therein, a conductive member to be received in the first passageway, the conductive member having a first end to receive a cable end and having a transverse internally threaded opening adjacent a second end thereof being accessible via the second passageway, the loadbreak probe to be received in the second passageway and comprising:

a loadbreak probe body; and an externally threaded end connected to said loadbreak probe body to be threaded into the transverse internally threaded opening of the conductive member;

said externally threaded end comprising a proximal portion and a self-aligning, anti-cross threading tip connected thereto;

said proximal portion comprising a proximal shaft having a constant predetermined diameter and a proximal helical rib extending radially outwardly a first distance from said proximal shaft;

said self-aligning, anti-cross threading tip comprising a distal shaft connected to said proximal shaft and a distal helical rib connected to said proximal helical rib and extending radially outwardly from said distal shaft a second distance less than the first distance, said distal helical rib also terminating prior to an end of said distal shaft to define an unthreaded lead-in.

10. The loadbreak probe of claim 9 wherein said proximal portion of said externally threaded end has a length matching a depth of the transverse internally threaded opening of the conductive member.

11. The loadbreak probe of claim 9 wherein said distal helical rib has a rounded over outer shape.

12. The loadbreak probe of claim 9 wherein said distal helical rib has a flat outer shape.

13. The loadbreak probe of claim 9 wherein said distal shaft has an enlarged diameter along the unthreaded lead-in.

14. A method for making loadbreak electrical connector comprising:

forming a housing having first and second intersecting passageways therein;

forming a conductive member to be received in the first passageway, the conductive member having a first end to receive a cable end and having a transverse internally threaded opening adjacent a second end thereof being accessible via the second passageway; and forming a loadbreak probe to be received in the second passageway, the loadbreak probe having an externally threaded end to be threaded into the transverse internally threaded opening of the conductive member;

the externally threaded end comprising a proximal portion and a self-aligning, anti-cross threading tip connected thereto;

the proximal portion comprising a proximal shaft having a constant predetermined diameter and a proximal helical rib extending radially outwardly a first distance from the proximal shaft;

the self-aligning, anti-cross threading tip comprising a distal shaft connected to the proximal shaft and a distal helical rib connected to the proximal helical rib and extending radially outwardly from the distal shaft a second distance less than the first distance, the distal helical rib also terminating prior to an end of the distal shaft to define an unthreaded lead-in.

15. The method of claim 14 wherein the proximal portion of the externally threaded end has a length matching a depth of the transverse internally threaded opening of the conductive member.

16. The method of claim 14 wherein the distal helical rib has a rounded over outer shape.

17. The method of claim 14 wherein the distal helical rib has a flat outer shape.

18. The method of claim 14 wherein the distal shaft has an enlarged diameter along the unthreaded lead-in.

* * * * *

UNITED STATES PATENT AND TRADEMARK OFFICE

CERTIFICATE OF CORRECTION

PATENT NO. : 7,234,980 B2
APPLICATION NO. : 11/380534
DATED : June 26, 2007
INVENTOR(S) : Roy E. Jazowski and Paul W. Lubinsky It is certified that error appears in the above-identified patent and that said Letters Patent is hereby corrected as shown below:

| | |
|---|---|
| Column 8, Line 3 | Delete: "making loadbreak"<br>Insert: --making a loadbreak-- |

Signed and Sealed this

Thirtieth Day of September, 2008

JON W. DUDAS
*Director of the United States Patent and Trademark Office*